United States Patent [19]

Martin

[11] Patent Number: 5,011,427

[45] Date of Patent: Apr. 30, 1991

[54] CORD PROTECTOR

[76] Inventor: Eugene Z. Martin, 1821 NW. 39th, Oklahoma City, Okla. 73118

[21] Appl. No.: 492,912

[22] Filed: Mar. 13, 1990

[51] Int. Cl.[5] ..... H01R 13/62

[52] U.S. Cl. ..... 439/373; 439/470

[58] Field of Search ..... 439/345, 347, 367, 368, 439/369, 373, 451, 464, 470, 471

[56] References Cited

U.S. PATENT DOCUMENTS

| | | | |
|---|---|---|---|
| 3,538,484 | 11/1970 | Passafiume | 439/373 |
| 4,618,200 | 10/1986 | Roberts et al. | 439/373 |
| 4,789,353 | 12/1988 | Busta et al. | 439/373 |

*Primary Examiner*—David L. Pirlot
*Assistant Examiner*—J. R. Daulton
*Attorney, Agent, or Firm*—Richard C. Litman

[57] ABSTRACT

A device that prevents the inadvertent removal of a plug from an electrical socket. The present invention provides a device that can be adapted to an existing electrical socket that prevents the removal of the plug from the socket. The device can be manipulated to accommodate a wide variety of plug sizes. In addition, the device is not cumbersome in that it need not be fitted over nor adapted to the plug prior to use. The present invention provides a severable element to accomplish its function.

9 Claims, 1 Drawing Sheet

CORD PROTECTOR

BACKGROUND OF THE INVENTION

1. Field of the Invention

The present invention relates to those devices designed to prevent the separation of a plug from an electrical outlet. More specifically, the present invention relates to those devices that can be connected or attached to an electrical outlet to prevent the inadvertent removal of an electrical plug from its respective socket.

2. Description of the Prior Art

There have been numerous developments of devices that prevent the removal of a plug from an electrical outlet. Of these patents, few describe a means to attach plugs of various sizes to their respective outlets. Many focus on singular plug shapes and designs and require the attachment of devices to the plug itself in order for the entire device to operate effectively. The present invention provides a simplified approach to this common problem. Of those inventions previously disclosed to the U.S. Patent Office, the following are the most pertinent.

U.S. Pat. No. 3,601,757 issued to Glenn D. Gober on Aug. 24, 1971 discloses an electrical wall outlet having threaded indentations around each of the two outlets. Provided with this particular embodiment are threaded elements that can be screwed into the respective areas on the outlet. The plug is surrounded with this threaded element. When the plug is inserted into the socket, the threaded element surrounding the plug can be screwed into place thereby securing the plug to the socket. Although this system is effective, the requirement of separate parts can be cumbersome. The assembly of these parts can also be time consuming.

U.S. Pat. No. 3,811,104 issued to Thomas B. Caldwell on May 14, 1974 discloses a safety device for an electrical wall outlet. In this disclosure, a two prong device is screwed into place around the plug. Such an arrangement prevents the inadvertent removal of the plug from the respective wall socket. However, it prevents the utilization of both outlets simultaneously. Moreover, to remove the wall socket protector, a screw must be removed. This makes the application both cumbersome and time consuming.

U.S. Pat. No. 4,083,618 issued to Francis W. Beck, Jr. on Apr. 11, 1978 discloses a safety enclosure that surrounds an electrical outlet. This safety enclosure prevents the inadvertent removal of a plug from its respective outlet. Though useful, this invention does not allow for any number of plug sizes within the same enclosure. Thus, theoretically, if the plug were larger, the enclosure would have to be replaced with one of a concordantly larger size. This is a cumbersome and time consuming process.

The above mentioned patents are by no means inclusive of all designs possible. However, they do present a representative sample of the types of inventions to date. The present invention addresses some of the fallacies related to the aforementioned inventions, and solves these problems in a comprehensive manner. Thus, the present invention provides a unique improvement over the prior art.

SUMMARY OF THE INVENTION

Thus, it is an object of the present invention to provide a device that will prevent the inadvertent removal of an electrical plug from its respective electrical socket.

It is an object of the present invention to provide an apparatus to prevent the inadvertent removal of a plug from its respective electrical outlet in order to prevent a child from injuring himself should he have the inclination to tamper with electricity. The present invention will prevent a small child from injuring himself.

It is another object of the present invention to prevent the removal of a plug from its respective electrical socket in order to reduce accidents associated with a mechanical workshop. Often, persons are injured when a plug is pulled out of an outlet and then hastily replaced. A machine operator, not expecting that power will suddenly return to his equipment, may be injured by such.

It is still another object of the present invention to provide such a device which can be adapted to any number of plug sizes and prevent the inadvertent removal of these plugs from their respective outlets.

It is another object of the present invention to provide a device that can be easily installed over an existing electrical socket.

It is yet another object of the present invention to provide a device which prevents the inadvertent removal of a plug from its respective electrical socket which can be easily disassembled for placement of a plug therein.

It is another object of the present invention to provide a device that can be easily and readily reassembled once the plugs have been inserted into the electrical outlet.

It is still another object of the present invention to provide a device that retains its fortitude when assembled so that it might best prevent the inadvertent removal of a plug from its respective outlet.

It is another object of the present invention to provide a device which can be readily manufactured.

It is still another object of the present invention to provide a device that can be manufactured inexpensively.

With these and other objects in view which will more readily appear as the nature of the invention is better understood, the invention resides in the novel combination and arrangement of parts hereinafter more fully described and illustrated, with reference being made to the accompanying drawings.

BRIEF DESCRIPTION OF THE DRAWINGS

Similar reference characters designate corresponding parts throughout the various figures of the drawings.

DESCRIPTION OF THE PREFERRED EMBODIMENT

Figure 1:
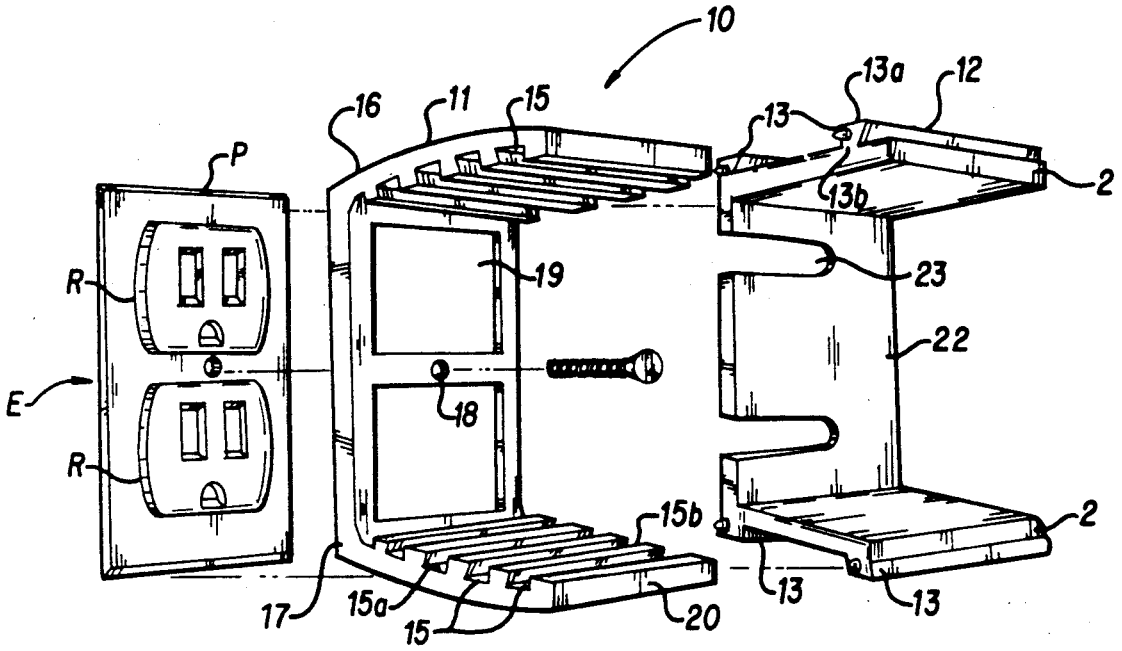
FIG. 1 is an exploded perspective of the present invention.
Figure 2:
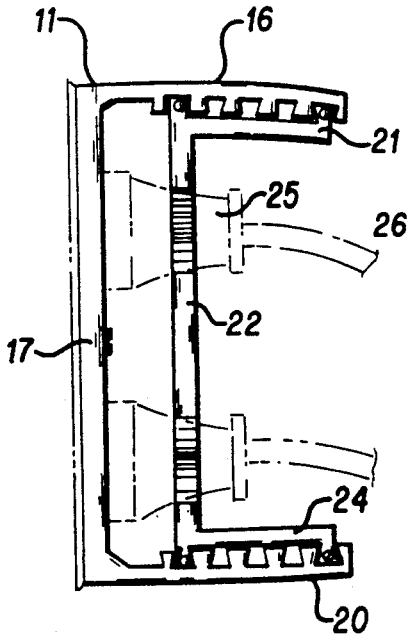
FIG. 2 is a side elevation of the present invention shown attached to an electrical outlet. Standard plugs are illustrated to demonstrate the domestic applicability of the present invention.
Figure 3:
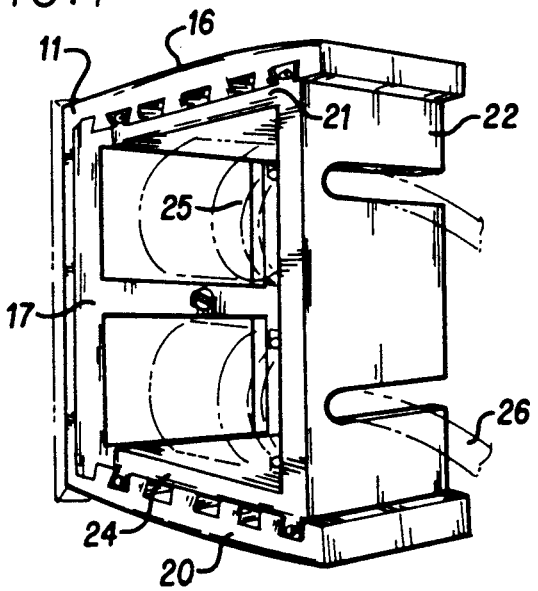
FIG. 3 is a perspective illustration of the present invention in an alternate embodiment. In this illustration, the plug protector is holding heavy duty plugs in place rather than standard household plugs.

The present invention, an apparatus to prevent the inadvertent removal of a plug from its respective receptacle, is generally designated 10 in FIG. 1. The present invention can be divided into essentially two separate components. The first of these components is the wall mounted bracket 11. The second of these components is the slidable member 12. The wall mounted bracket 11 and the slidable member 12 can be subdivided into their respective elements. The following discussion describes the interrelation of the elements to the two components mentioned and describes how the wall mounted bracket 11 and the slidable member 12 work together to accomplish the purpose of the invention.

The wall mounted bracket 11 is essentially a U-shaped member. It has three separate subcomponents, the wall mounted bracket top element 16, the wall mounted bracket vertical element 17, and the wall mounted bracket bottom element 20. The wall mounted bracket top element 16 and the wall mounted bracket bottom element 20 are essentially of the same length. Both project from the plane of the wall mounted vertical element 17 to which they are irremovably attached.

The wall mounted bracket vertical element 17 defines two specific areas essential to the functioning of the plug protector 10. The first is the screw aperture 18. The screw aperture 18 is positioned on the wall mounted bracket vertical element 17 in such a manner as to allow the plug protector 10, when mounted over an electrical outlet, to appear evenly displaced thereover.

There are also plug apertures 19 provided on the wall mounted bracket vertical element 17. The plug apertures 19 are simply holes cut through the wall mounted bracket vertical element 17. They allow placement of the plug 25 into its respective receptacle R when the plug protector 10 has been mounted in place over the electrical outlet.

The wall mounted bracket 11 has two additional elements in its construction. The first of these elements is the wall mounted bracket top element 16. The second of these elements is the wall mounted bracket bottom element 20. The wall mounted bracket top element 16 and the wall mounted bracket bottom element 20 are essentially planar structures projecting at some angle, preferably ninety degrees, from the plane defined by the wall mounted bracket vertical element 17.

The slidable member 12 can be defined in much the same manner as the wall mounted bracket 11. The slidable member 12 has three basic subcomponents, the slidable member top element 21, the slidable member bottom element 24, and the slidable member vertical element 22. The slidable member top element 21 and the slidable member bottom element 24 both extend from the slidable member vertical element 22. In fact, they project from the plane defined by the slidable member vertical element 22 preferably at ninety degree angles with the slidable member vertical element 22.

However, it should be noted at this point that the top and bottom elements of both the wall mounted bracket 11 and the slidable member 12 may project from the vertical elements at any angle and are not limited to ninety degrees only. The ninety degree construction is utilized in this discussion as a reference only and has no bearing upon the restriction of the present invention.

The slidable member vertical element 22 contains electrical cord indentations 23. The electrical cord indentations 23 are provided in order to allow the electrical cord 26 from the plug 25 to pass easily beyond the slidable member 12. The slidable member vertical element 22 also serves to hold the plug 25 in place when the slidable member 12 is placed within the boundaries defined by the wall mounted bracket 11.

Overall, the distance between the wall mounted bracket top element 16 and the wall mounted bracket bottom element 20 is greater than the distance between the slidable member top element 21 and the slidable member bottom element 24. This allows the removable engagement of the slidable member 12 within the wall mounted bracket 11.

However, an alternate embodiment could be envisioned where the slidable member 12 width is greater than the wall mounted bracket 11 width. In this instance, the slidable member top element 21 would sit atop the wall mounted bracket top element 16. Conversely, the slidable member bottom element 24 would rest on the bottom surface of the wall mounted bracket bottom element 20.

In the first embodiment, contained on the top side of the slidable member top element 21 and the bottom surface of the slidable member bottom element 24 are slidable member engaging tracks 13. The obverse of the slidable member engaging tracks 23 are the wall mounted bracket engaging grooves 15. The wall mounted bracket engaging grooves 15 are located on the bottom surface of the wall mounted bracket top element 16 and the top surface of the wall mounted bracket bottom element 20.

However, in the second embodiment, the wall mounted bracket engaging grooves 15 would need be placed on the top surface of the wall bracket top element 16 and the bottom surface of the wall mounted bracket bottom element 20. The slidable member engaging tracks would need be placed on the bottom surface of the slidable member top element 21 and the top surface of the slidable member bottom element 24.

The retaining function of plug protector 10 is enhanced by the specific shape of tracks 13 and grooves 15. Grooves 15 are wider at their bases **15*a* than at their tops 15*b*. Tracks 13 are correspondingly shaped, with the topmost dimension 13*a* of the tracks 13 being wider than the space 13*b* between the base of the tracks 15. Thus, when slidable member 12 is engaged with wall or outlet mounted bracket 11 and tensional force is applied to any electrical cord 26 which is attached to any electrical plug 25 retained therein, the interlocking capability provided by the above described shapes of tracks 13 and grooves 15 will prevent the top and bottom elements 16 and 20 of wall or outlet mounted bracket 11 from spreading and thus precluding slidable member 12 from being pulled from wall or outlet mounted bracket 11**.

The plug protector 10 is easily attached to an existing outlet E. In order to mount the plug protector 10 to an electrical outlet E, one simply removes the existing screw from the electrical outlet plate P. Following this, the wall mounted bracket 11 is aligned over the electrical outlet plate P and a screw is placed through the screw aperture 18 on the wall mounted bracket vertical element 17. The screw is then inserted into the screw socket and threadably engages the female connector located behind the electrical outlet plate P. The screw is tightened thereby installing the plug protector 10.

Following this, a plug 25 can be inserted into the electrical receptacle R, and the slidable member 12 can be inserted in the wall mounted bracket 11. Once in place, the slidable member 12 prevents the inadvertent removal of the plug 25 from its respective electrical receptacle.

It is to be understood that the present invention is not limited to the sole embodiment described above, but encompasses any and all embodiments within the scope of the following claims.

I claim:

1. In an electrical outlet having a plurality of receptacles, said receptacles each providing for the removable installation of an electrical plug having two or more terminals, the combination comprising;

an apparatus to prevent the inadvertent removal of one or more of said plugs from one or more of said receptacles, including;

an outlet mounted bracket attachable in overlying relationship to said outlet by means of an outlet cover plate retaining screw, said outlet mounted bracket having a first element and a second element, said outlet mounted bracket first and second elements extending substantially perpendicularly from opposite ends of said outlet mounted bracket, said outlet mounted bracket first and second elements including essentially planar and parallel facing surfaces and opposed surfaces, said outlet mounted bracket containing a plurality of apertures each providing for the insertion of one said electrical plug therethrough and into said electrical receptacle, a slidable member including a first element and a second element in substantially parallel relationship and perpendicularly extending from a central element positioned therebetween, said slidable member first element and second elements having facing and opposing surfaces, said slidable member central element containing elongated indentations permitting the reception of an electrical cord but not allowing the passage of one said plug, the major axes of said indentations substantially parallel to said slidable member first and second elements, and slidably engageable mating connection means on said first and second elements of said bracket and slidable member.

2. The apparatus of claim 1 wherein;

said slidable member first and second element opposing surfaces are spaced apart so as to closely fit between said facing surfaces of said outlet mounted bracket first and second elements.

3. The apparatus of claim 1 wherein;

said slidable member first and second element facing surfaces are spaced apart so as to closely fit over said opposing surfaces of said outlet mounted bracket first and second surfaces.

4. The apparatus of claim 2 wherein;

said connection means includes a plurality of parallel grooves on said bracket first element and said second element facing surfaces, and said connection means further including at least one track disposed upon said slidable member first and second element opposing surfaces.

5. The apparatus of claim 4 wherein;

said grooves and tracks define a keystone configuration in cross section, whereby upon slidably engaging said tracks of said slidable member elements with said grooves of said outlet mounted bracket elements an interlocking relationship is formed so that said tracks are restrained from removal from within said grooves by a force in any direction other than parallel to said tracks and said grooves.

6. A method of preventing the inadvertent removal of one or more electrical plugs from an electrical outlet and using the apparatus of claim 4, the method comprising the following steps;

removing any attachment means which may be holding an electrical outlet cover plate in place, positioning said outlet mounted bracket over said cover plate and reinstalling said attachment means through said outlet mounted bracket and said cover plate, installing one or more electrical plugs within said electrical outlet receptacles, and slidably installing said slidable member into position over said electrical plugs in a manner allowing said tracks to engage said grooves and said indentations to pass around the cords of said electrical plugs, thereby preventing said electrical plugs from disconnection from said electrical outlet receptacles by means of a tensional force exerted upon said cords of said electrical plugs.

7. The apparatus of cliam 3 wherein;

said connection means includes a plurality of parallel grooves on said bracket first element and said second element facing surfaces, and said connection means further including at least one track disposed upon said slidable member first and second element opposing surfaces.

8. The apparatus of claim 7 wherein;

said grooves and tracks define a keystone configuration in cross section, whereby upon slidably engaging said tracks of said slidable member elements with said grooves of said outlet mounted bracket elements an interlocking relationship is formed so that said tracks are restrained from removal from within said grooves by a force in any direction other than parallel to said tracks and said grooves.

9. A method of preventing the inadvertent removal of one or more electrical plugs from an electrical outlet and using the apparatus of claim 7, the method comprising the following steps;

removing any attachment means which may be holding an electrical outlet cover plate in place, positioning said outlet mounted bracket over said cover plate and reinstalling said attachment means through said outlet mounted bracket and said cover plate, installing one or more electrical plugs within said electrical outlet receptacles, and slidably installing said slidable member into position over said electrical plugs in a manner allowing said tracks to engage said grooves and said indentations to pass around the cords of said electrical plugs, thereby preventing said electrical plugs from disconnection from said electrical outlet receptacles by means of a tensional force exerted upon the cords of said electrical plugs.

* * * * *